US005588187A

United States Patent [19]

Swain

[11] Patent Number: 5,588,187

[45] Date of Patent: Dec. 31, 1996

[54] EXTRUDED ZIPPERS FOR UPHOLSTERY APPLICATIONS

[75] Inventor: Henry L. Swain, Readington, N.J.

[73] Assignee: Illinois Tool Works Inc., Glenview, Ill.

[21] Appl. No.: 516,297

[22] Filed: Aug. 17, 1995

[51] Int. Cl.[6] ..... A44B 17/00; B65D 33/00

[52] U.S. Cl. ..... 24/587; 24/400; 24/576; 383/63

[58] Field of Search ..... 24/587, 576, 400; 383/63, 65

[56] References Cited

U.S. PATENT DOCUMENTS

| | | | |
|---|---|---|---|
| 3,038,225 | 6/1962 | Ausnit | 24/587 |
| 3,654,049 | 4/1972 | Ausnit | 383/63 |
| 3,918,131 | 11/1975 | Ausnit | 24/576 |
| 5,248,201 | 9/1993 | Kettner et al. | 24/587 |

*Primary Examiner*—Victor N. Sakran
*Attorney, Agent, or Firm*—Kane, Dalsimer, Sullivan, Kurucz, Levy, Eisele and Richard, LLP

[57] ABSTRACT

An extruded zipper for use in closing out vehicle seat backs has a first and a second flexible closure strip, each of which includes a web and a flange extending parallel to one another from an interlocking portion. The web and flange on each flexible closure strip are separated from one another by a groove, which is used to dispose the interlocking portions in a stacked relationship to one another, so that they may be joined with a hammer-like blow delivered in a direction perpendicular to the webs. The webs are attached to opposite sides of the opening in a seat back cover, which is provided in a premanufactured sack-like configuration. In a method for closing out vehicle seat backs using the extruded zipper, the grooves enable the interlocking portions of the flexible closures strips to be positioned in the required stacked relationship prior to the delivery of the interlocking blow.

9 Claims, 2 Drawing Sheets

EXTRUDED ZIPPERS FOR UPHOLSTERY APPLICATIONS

BACKGROUND OF THE INVENTION

1. Field of the Invention

The present invention relates to zippers comprising interlocking flexible closure strips extruded from synthetic polymeric resin materials. More specifically, it is a zipper of this variety intended for use in closing out the covers of automobile seat backs in a manner that is unseen by, or hidden from, the casual observer. The flexible closure strips include webs to which seat cover material may be connected, sewn or attached in a conventional manner.

2. Description of the Prior Art

In the manufacture of seats for automobiles, trucks and other motor vehicles, a seat back, which may include a rigid frame having at least some resilient padding material attached thereto, is often covered from the top with a pre-manufactured, sacklike seat cover. The seat back must then be "closed out" at the bottom thereof by securing the sides of the seat cover opening to one another. Ordinarily, the closure, which runs along the bottom of the seat back, is hidden from view, as, in a fully assembled seat, it resides in the tight space between the bottom of the seat back and the substantially horizontal portion of the seat forming the seating surface.

In the past, automobile seat covers, including seat back covers have been closed out using conventional zippers comprising interlocking teeth and a pull tab. While strong and reliable, and capable of being closed in an unsupported situation (that is, without requiring a firm backing surface), conventional zippers are an unnecessarily expensive means for closing out a seat back cover which is never intended to be reopened. In addition, they may be very difficult to hide completely from view.

Auto manufacturers have long searched for alternatives to conventional zippers for use in closing out seat covers, including seat back covers. So-called J-bar and arrow fasteners provide a good alternative, but carry the disadvantage of requiring a support surface against which they may be fastened. This hampers their use in auto seating, as much of the interior of an auto seat is either empty, or filled with quite resilient foam.

Manufacturers have attempted to circumvent this disadvantage by closing out auto seat backs having J-bar fasteners in an apparatus having a rigid plate member which is inserted into one of the two halves of the fastener to provide the required rigid support and to immobilize that half of the fastener. The rigid plate also stretches that side of the auto seat back cover across the bottom of the seat back. The operator of the apparatus then manually stretches the other side of the opening of the seat back cover across the bottom of the seat so that the other half of the J-bar fastener attached thereto may be engaged with the immobilized one.

From a technical point of view, this method of closing out auto seat backs has proven to be quite satisfactory. However, the repetitive motion required by the operator who must manually close out hundreds of seat backs in a typical work shift with a turning wrist action has been the source of many work-related injuries, including those of the repetitive motion type producing what has come to be known as carpal tunnel syndrome.

The present invention provides a solution to this problem of the prior art.

SUMMARY OF THE INVENTION

The present invention is an extruded zipper for closing out vehicle seat backs, and a method for closing out vehicle seat backs using the zipper.

The extruded zipper comprises a first and a second flexible closure strip. Each flexible closure strip has a web, an interlocking portion, and a flange. The web and flange on each strip extend substantially parallel to one another from the interlocking portion. Between the web and flange is a groove which, in the method, is used to position the interlocking portions in a stacked relationship to one another, so that they may be joined with a hammer-like blow delivered perpendicular to the webs and flanges of the flexible closure strips.

In the method, the extruded zipper is used to close the opening of a seat back cover following the installation thereof on a seat back frame. The webs of the flexible closure strips are attached to opposite sides of the seat back cover. The seat back frame is inserted into the seat back cover, which is premanufactured in a sack-like configuration.

An operator inserts the covered seat back frame into an apparatus having a stationary rigid plate, a movable rigid plate, and a closing bar. The stationary rigid plate is inserted into the groove in one of the first and second flexible closure strips, and the movable rigid plate is inserted into that of the other of the first and second flexible closure strips and moved to place the interlocking portions into an overlying relationship below the closing bar. Finally, the closing bar is activated to deliver a downward hammer-like blow to join the interlocking portions together.

The present invention will now be described in more complete detail with reference being made to the drawing figures identified below.

DETAILED DESCRIPTION OF THE PREFERRED EMBODIMENT

Figure 1:
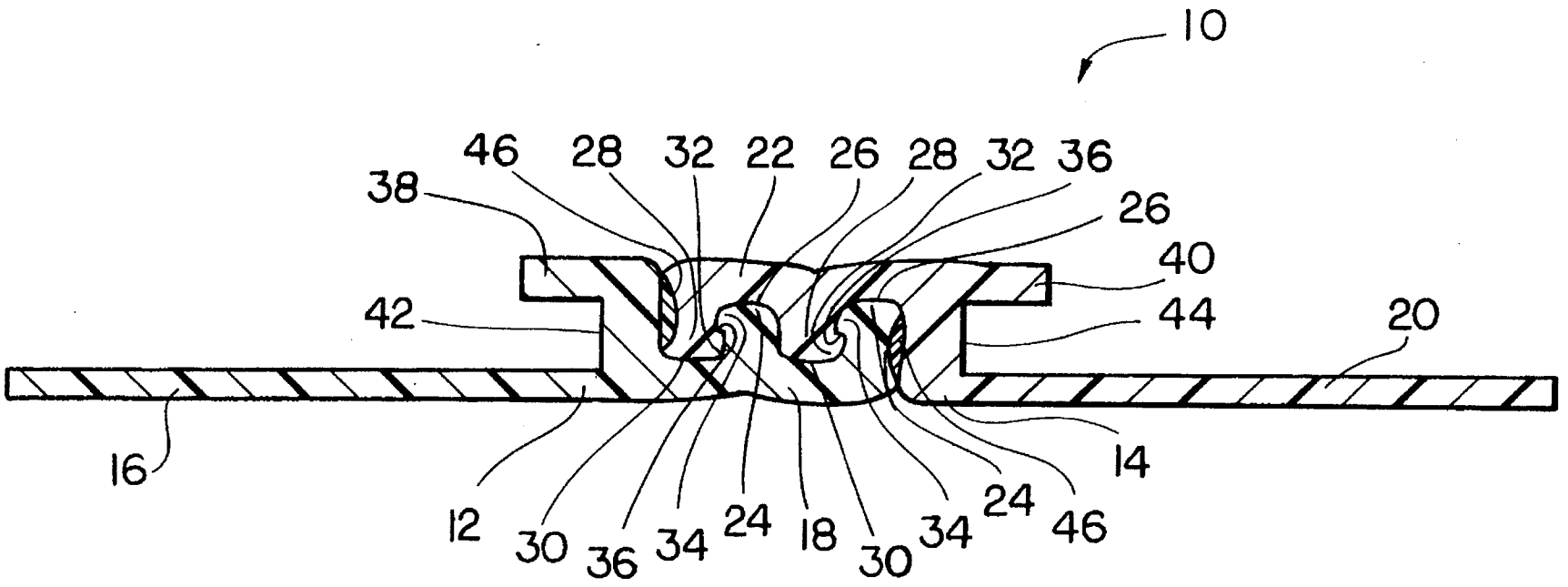
FIG. 1 is a cross-sectional view of the zipper of the present invention.

Turning now to FIG. 1, a cross-sectional view of the zipper 10 of the present invention, the zipper 10 comprises a first flexible closure strip 12 and a second flexible closure strip 14. As may be observed in FIG. 1, the first flexible strip 12 and the second flexible closure strip 14 are not identical to one another. First flexible closure strip 12 includes a web 16 and an interlocking portion 18 coplanar therewith, while second flexible closure strip 14 includes a web 20 and an interlocking portion 22 not coplanar therewith. As a consequence, the webs 16, 20 are coplanar with each other, as shown, when interlocking portions 18, 22 are engaged with one another.

Zipper 10 is of the variety known in the industry as a two-track zipper, and is so named because interlocking portions 18, 22 each have two ribs and two channels which interlock with those of the other. A two-track zipper is shown for the purposes of illustration, as the present invention may be practiced with three-track or other zippers.

Referring back to FIG. 1, ribs 24 of interlocking portion 18 of first flexible closure strip 12 interlock with channels 26 in interlocking portion 22 of second flexible closure strip 14.

In like manner, ribs 28 of interlocking portion 22 interlock with channels 30 in interlocking portion 18. Ribs 24, 28 have enlarged heads 32, 34, respectively, which facilitates their interlocking with channels 26, 30 by interference fit into the enlarged bottoms thereof. Enlarged heads 32, 34 may be provided by hooks 36 on ribs 24, 28, as shown. This also ensures that the bottom of the adjacent channel will be enlarged.

First flexible closure strip 12 and second flexible closure strip 14 also have flanges 38, 40, respectively. Flange 38 is separated from web 16 on first flexible closure strip 12 by groove 42. Likewise, flange 40 is separated from web 20 on second flexible closure strip 14 by groove 44. The purpose of grooves 42, 44 will be explained below. Flanges 38, 40 are substantially coplanar with one another, and flange 40 is substantially coplanar with interlocking portion 22 of second flexible closure strip 14.

The outboard rib 24 of interlocking portion 18 and the outboard rib 28 of interlocking portion 22 may be provided with color lines 46 to provide a visual indication to a user that interlocking portions 18, 22 are not interlocked with one another. This is accomplished by providing color lines 46 in positions such that will be hidden from view within inboard channels 26, 30 upon a complete interlocking of interlocking portions 18, 22.

First and second flexible closure strips 12, 14 are extruded from a polymeric resin material. This material may be a low to medium density polyethylene, or polypropylene or polyurethane. In general, it may be a polymeric material having a hardness in the range from 60 to 95 durometer. When provided, the color line 46 may be coextruded with the first and/or second flexible closure strips 12, 14 from a compatible polymeric resin material, which may simply be the same polymeric resin material with a different coloring agent.

The entire zipper 10, as depicted in FIG. 1, may be on the order of 3.0 inches wide and 0.25 inches high.

Figure 2:
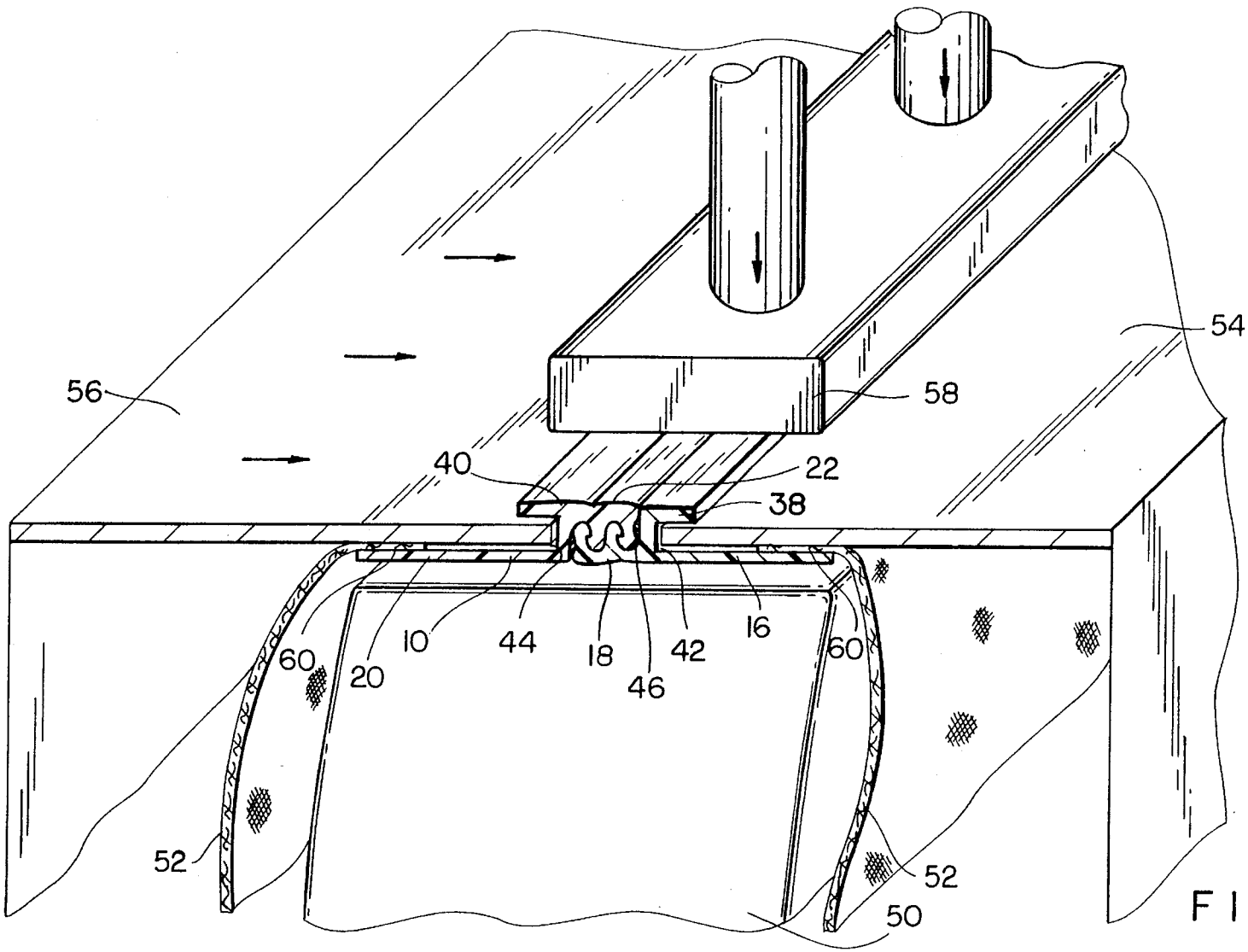
FIG. 2 schematically illustrates the practice of the method of closing out a vehicle seat back using the zipper.

Zipper 10 is intended for use in closing out automobile seat backs, although its use is not to be considered restricted to this purpose alone. Referring to FIG. 2, an automobile seat back 50, which comprises a frame and resilient padding which are not shown, is covered from the top with a sack-like seat cover 52 having an opening closed by zipper 10 of the present invention. Once covered, the seat back 50 is disposed upside down in an apparatus having a stationary rigid plate 54. The operator manually positions the seat back 50 in the apparatus, inserting stationary rigid plate 54 into groove 42 between web 16 and flange 38 of zipper 10.

The apparatus also includes a movable rigid plate 56, which the operator inserts into groove 44 between web 20 and flange 40 of zipper 10. Movable rigid plate 56 is movable up to a point where interlocking portion 22 is disposed directly over interlocking portion 18, and is secured or fixed at that point to hold interlocking portions 18, 22 in such a disposition.

Finally, a closing bar 58, operated by pneumatic or hydraulic cylinders delivers a downward hammer-like blow onto interlocking portion 22, snapping it downward into interlocking portion 18. Both stationary rigid plate 54 and movable rigid plate 56 together provide the necessary backing support to ensure that interlocking portions 18, 22 snap together with the hammer-like blow provided by closing bar 58. When closing bar 58 is raised following delivery of the blow to interlocking portion 22, the operator may make a visual check, perhaps aided by the use of a color line 46, to ensure that the interlocking portions 18, 22 have been successfully joined.

Seat cover 52 may be secured to webs 16, 20 at points 60 in any of a number of fashions, such as sewing or bonding, depending on the material from which the seat cover 52 is made.

Clearly, modifications to the above would be obvious to those skilled in the art, but would not bring the invention so modified beyond the scope of the appended claims.

What is claimed is:

1. An extruded zipper comprising:

a first flexible closure strip and a second flexible closure strip; each flexible closure strip being extruded from a polymeric resin material, and having a web, an interlocking portion, and a flange; said web and said flange of each flexible closure strip extending from its respective interlocking portion substantially parallel to one another and defining therebetween on each flexible closure strip a groove; said interlocking portions of said first and second flexible closure strips being interlockable with one another in an interference fit; wherein said web and said interlocking portion of said first flexible closure strip are substantially coplanar with one another; said web and said flange of said second flexible closure strip are substantially coplanar with one another; and said grooves between said flange and said web of each of said first and second flexible closure strips are of substantially identical width;

so that, when said interlocking portions of said first and second flexible closure strips are interlocked with one anther, said flanges of said first and second flexible closure strips are substantially coplanar with one another and said webs of said first and second flexible closure strips are substantially coplanar with one another.

2. An extruded zipper as claimed in claim 1 wherein said polymeric resin material has a hardness in the range from 60 to 95 durometer.

3. An extruded zipper as claimed in claim 1 wherein said polymeric resin material is selected from a group consisting of low to medium density polyethylene, polypropylene and polyurethane.

4. An extruded zipper as claimed in claim 1 wherein said interlocking portion of said first flexible closure strip includes at least one rib and at least one channel, and said interlocking portion of said second flexible closure strip includes at least one rib and at least one channel which are interlockable with those of said first flexible closure strip in an interference fit.

5. An extruded zipper as claimed in claim 4 wherein said at least one rib of said interlocking portion of at least one of said first and second flexible closure strip includes a color line to provide a visual indication when said interlocking portions of said first and second flexible closure strips are not completely interlocked with one another.

6. An extruded zipper as claimed in claim 5 wherein said color line is coextruded with said at least one of said first and second flexible closure strips from a compatible polymeric resin material.

7. An extruded zipper as claimed in claim 4 wherein said at least one rib of said interlocking portion of each of said first and second flexible closure strips has an undercut interlocking hook along a side thereof to form an enlarged head for said rib and an enlarged bottom for an adjacent channel to provide said interference fit.

8. An extruded zipper as claimed in claim 1 wherein said interlocking portion of at least one of said first and second flexible closure strips includes a color line to provide a visual indication when said interlocking portions of said first and second flexible closure strips are not completely interlocked with one another.

9. An extruded zipper as claimed in claim 8 wherein said color line is coextruded with said at least one of said first and second flexible closure strips from a compatible polymeric resin material.

* * * * *